United States Patent [19]

Anderson

[11] Patent Number: 5,060,992

[45] Date of Patent: Oct. 29, 1991

[54] DOOR LOCKING DEVICE

[76] Inventor: Joseph A. Anderson, 5333 Sherbrooke East, Apt. 1013 B, Montreal, Quebec, Canada, H1T 3W2

[21] Appl. No.: 667,485

[22] Filed: Mar. 11, 1991

[51] Int. Cl.[5] ..... E05C 3/04

[52] U.S. Cl. ..... 292/207; 292/106; 292/153

[58] Field of Search ..... 292/207, 208, 106, 153

[56] References Cited

U.S. PATENT DOCUMENTS

| | | | |
|---|---|---|---|
| 395,513 | 1/1889 | Powers | 292/207 |
| 987,285 | 3/1911 | Dare | 292/106 |
| 1,334,610 | 3/1920 | Hope et al. . | |
| 1,737,730 | 12/1929 | Reidhaar | 292/106 |
| 2,426,793 | 9/1947 | Schwartz | 292/106 |
| 2,533,360 | 12/1950 | Dath | 292/207 |
| 2,663,585 | 12/1953 | Tye | 292/106 |
| 2,683,049 | 7/1954 | Van der Spek | 292/207 |
| 4,475,364 | 10/1984 | Frank . | |

FOREIGN PATENT DOCUMENTS

| | | | |
|---|---|---|---|
| 452783 | 11/1948 | Canada . | |
| 871587 | 3/1971 | Canada . | |
| 329640 | 11/1920 | Fed. Rep. of Germany | 292/207 |
| 871 | of 1861 | United Kingdom | 292/207 |
| 30381 | of 1897 | United Kingdom | 292/207 |
| 19891 | of 1903 | United Kingdom | 292/207 |

*Primary Examiner*—Eric K. Nicholson

[57] ABSTRACT

A door lock for preventing unauthorized ingress and solely actuable from the inside of a room. The lock includes a lock bar, pivotally anchored to the outer edge of the door, and a jamb plate, anchored to the adjacent jamb and having an elongated vertical aperture for door locking engagement by the lock bar free end portion when the door is closed. A stem is slidably mounted on the lock bar to take a blocking position protruding beyond the free end portion of the lock bar for releasably extending through the jamb plate aperture. When the stem is engaged into the jamb plate aperture, the lock bar is prevented from pivoting because the stem has no clearance to do so within the aperture. Thus, a person outside the room could not release the lock bar by upward pivotal thereof, for instance by inserting a blade through the vertical air gap between the door outer edge and the jamb plate, underneath the lock bar, and then lifting same.

6 Claims, 2 Drawing Sheets

14a 14
12
16
16c
14
16b
14c
10
16a
16'
2

4
54b
42b
54a
5
5
16d
G
46
48
36
26
16'28
28a
38
42a 31
26
4

DOOR LOCKING DEVICE

FIELD OF THE INVENTION

This invention relates to the field of door locking apparatuses.

BACKGROUND OF THE INVENTION

In hotel rooms, night train compartments and the like public lodging facilities, a constant concern is burglary. Indeed, the door locks are often of simple construction, for example, with a lock bar pivotally mounted to the interior wall of the door to lockingly releasably engage an aperture in a jamb plate by pivotal action thereof. In its door locking condition, the lock bar usually rests by its own weight against the bottom edge of the jamb plate aperture, normally in a horizontal position; to release same, the room occupant rotates the lock bar counterclockwise (when the lock bar is on the right-hand side of the door) to lift the lock bar away from the jamb plate aperture, in an arc of a circle travel path. Accordingly, the overall vertical length of the door frame jamb plate aperture must be sufficiently greater than the overall width of the lock bar, to provide enough clearance above the lock bar, within the jamb plate aperture, for this upward sweeping motion of the lock bar.

Accordingly, thieves, simply by inserting a credit card or other thin, rigid implement, through the air gap between the closed door outer edge section and the jamb plate, are known to be able to lift the transversely-extending lock bar to pivot same to clear the jamb plate, which is to say, to release the door from the jamb. The door is then unlocked.

OBJECTS OF THE INVENTION

The gist of the invention is to prevent burglaries in public lodging facilities.

A corollary object of the invention is to provide means for the occupant of a public lodging facility to have heightened personal control over the locking devices on the door of the room that he occupies.

SUMMARY OF THE INVENTION

Accordingly with the invention, there is disclosed a door locking device for use in edgewisely locking to a first jamb of a door frame, a door hingedly mounted to the opposite jamb of that door frame, said door defining an interior wall facing a room and an exterior wall, the door locking device comprising: (a) a lock bar, to be anchored to the door; (b) means for anchoring said lock bar to the door swinging edge section against the interior wall thereof; (c) means for pivoting movement of said lock bar about a plane substantially parallel to said door; (d) a jamb plate, to be mounted to said first jamb and having an aperture for releasable engagement therethrough by said lock bar in a transverse, door-locking position once said door is closed; (e) an elongated latch member, carried by said lock bar for pivotal movement therewith and longitudinally movable relative to said lock bar between a first, retracted, inoperative position, clearing said jamb plate aperture, and a second, extended, operative position, in which it transversely engages said jamb plate aperture, once said door is closed; whereby any attempt to rotate said lock bar to its said latch member door unlocking position is prevented by engagement of said latch member with an edge of said jamb plate aperture.

Preferably, the latch member includes locking means, for releasably locking said latch member in at least its said second operative position.

Advantageously, said plane of movement of said lock bar is located interiorly beyond the plane of said jamb, when the door is closed; said jamb plate aperture being elongated, vertical and made in the interiorly projecting portion of said jamb plate which is anchored to said jamb orthogonally to the plane of the closed door; said aperture defining top and bottom edges, said lock bar, in its transverse, door locking position, extending horizontally through said aperture and abutting against the bottom edge thereof, said latch member in its said second operative position, extending within the clearance within said aperture between said aperture top edge and said transverse lock bar, and being of such dimensions as to positively prevent release of said lock bar from said aperture upon an attempt to rotate said lock bar towards its door unlocking position.

Profitably, said means for anchoring said lock bar to said door and for enabling rotation of the former, include bolt means extending through said door.

DETAILED DESCRIPTION OF THE INVENTION

Figure 5:
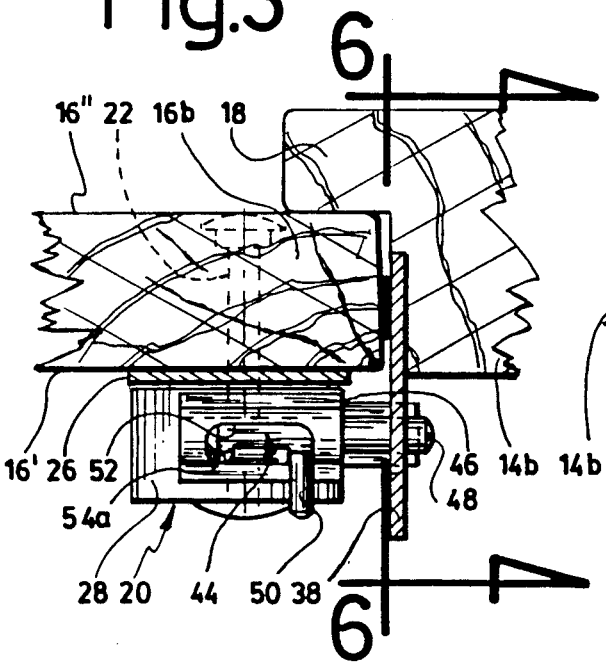

Upright wall 10 defines a large rectangular opening 12 bounded by a door frame 14. A door 16 is edgewisely hinged at **16*a* to a first door frame upright section or jamb 14*a*, via known hinge means (not illustrated). Door 16 defines a second edge 16*b* on the swinging edge section opposite hinge edge 16*a*, and top and bottom free edges 16*c* and 16*d* respectively clearing the top frame leg section 14*c* and the ground G. As clearly illustrated in FIG. 5, the second side leg or jamb 14*b* of the door frame 14 includes an inturned flange 18 on its exterior face, to constitute a door stop against which the exterior face 16″ of door 16 will abut when closed to its position substantially coplanar to frame 14**.

According to the invention, a door lock means 20 is installed to the edgewise section **16*b* of door 16, and to a registering section of jamb 14*b*. Means 20 can be at about one meter from ground, e.g.. Door lock means 20 includes an elongated bolt 22, extending through a boring 24 in door 16. A first rigid plate 26 is flatly applied against the interior face 16′ of door, and a rigid lock bar 28 is applied against plate 26. Through-bores 26*a* and 28*a* are made in plate 26 and lock bar 28, to be freely engaged by the shaft of bolt 22; the bolt head 22*a* is lodged into and edgewisely concealed by a cavity 30 made on the exterior face 16″ of door 16. Plate 26 is anchored to door 16 by screws 31. A nut 32 is screwed to the threaded end of bolt 22, so as to engage into and be edgewisely concealed by a cavity 34 made in the outer (free) wall of lock bar 28. A cylindrical plug 36 closes cavity 34 to completely conceal the bolt 22 and nut 32 from view by a person on the interior side of door 16. Plug 36** has an aesthetic purpose, and therefore, may be made of non rigid material, e.g. plastic or rubber.

A second rigid plate 38 or jamb plate is edgewisely anchored, e.g. by screws 40 (FIG. 6) to the jamb 14*b*, with the main portion thereof at 38*a* projecting interiorly from the plane of door frame 14. Main jamb portion 38*a* has a rectangular, vertical aperture 42.

Figure 6:
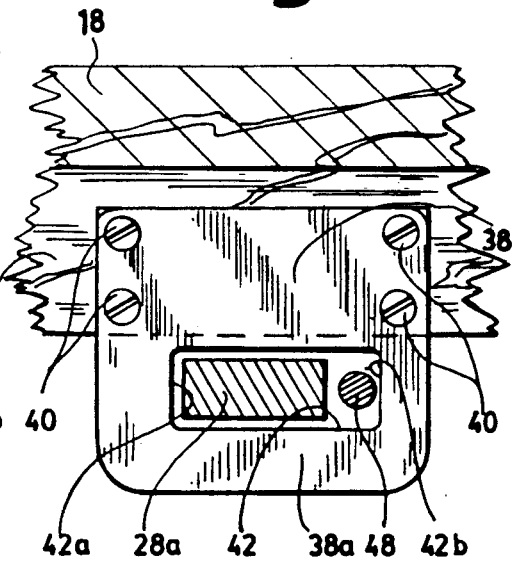
FIG. 6 is a cross-section taken along line 6—6 of FIG. 5.

Lock bar 28 is freely rotatable around shaft 22, and its main body is smaller than underlying plate 26 meaning that, during its rotation in a plane parallel to that of door 16, the lock bar main body remains edgewisely within the boundaries of plate 26. However, a rectangular, thin lock bar extension 28*a* extending parallel to plate 26, projects from one side of lock bar 28 integral thereto, for rotation therewith. When extension 28*a* is directed in a direction opposite the door hinge edge 16*a*, it extends beyond the plane of opposite door edge 16*b* and, indeed, beyond the plane of jamb 15*b* when the door is closed; in such position, and when door 16 is closed, lock bar extension 28*b* is designed to freely engage into and through an aperture 42 of jamb plate portion 38*a*, as illustrated in FIG. 6. Accordingly, the thickness of lock bar extension 28*b* must be slightly smaller than the width of rectangular aperture 42, and the width of the former, substantially smaller than the length of the latter. In its door locking position, lock bar 28 rests on the bottom edge 42*a* of jamb plate aperture 42 and the top of lock bar 28 is sufficiently spaced from the top edge 42*b* of jamb plate aperture 42 to allow the lock bar extension 28*b* to clear the aperture top edge 42*a* during pivoting of the lock bar 28 between door opening and closing positions.

Figure 3:
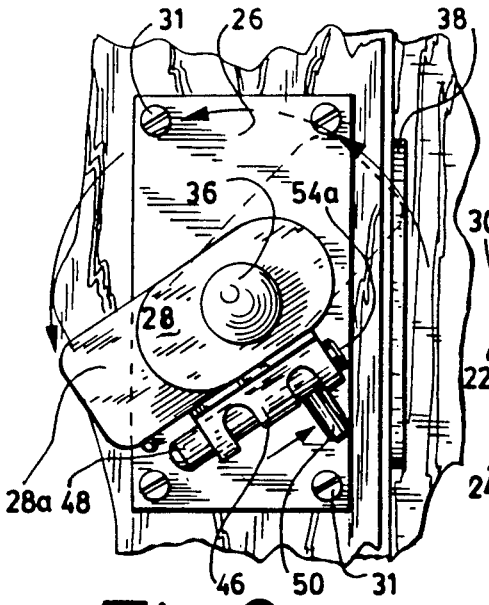
Figure 4:
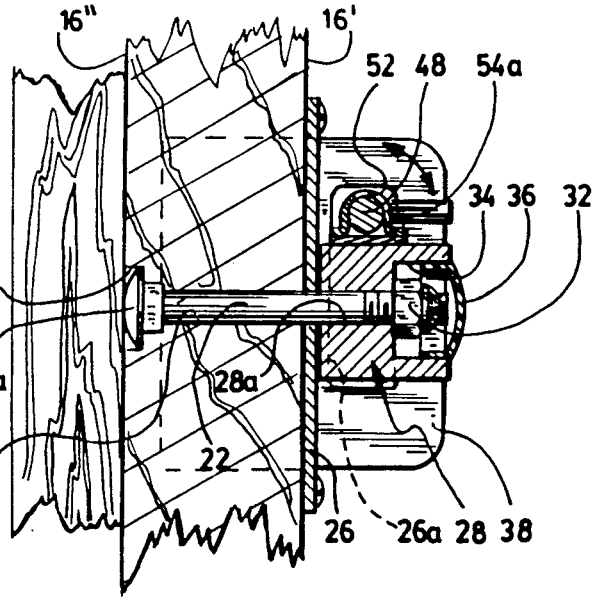
FIGS. 4–5 are cross-sectional views taken along lines 4—4 and 5—5 of FIG. 2.

Preferably, the two corners of extension 28*b* are rounded, as shown in FIG. 3, to prevent injury. Obviously the tightness of screwing of nut 32 to bolt 22 is low enough to enable free manual rotation of lock bar 28 around bolt 22.

Figures 1, 2:
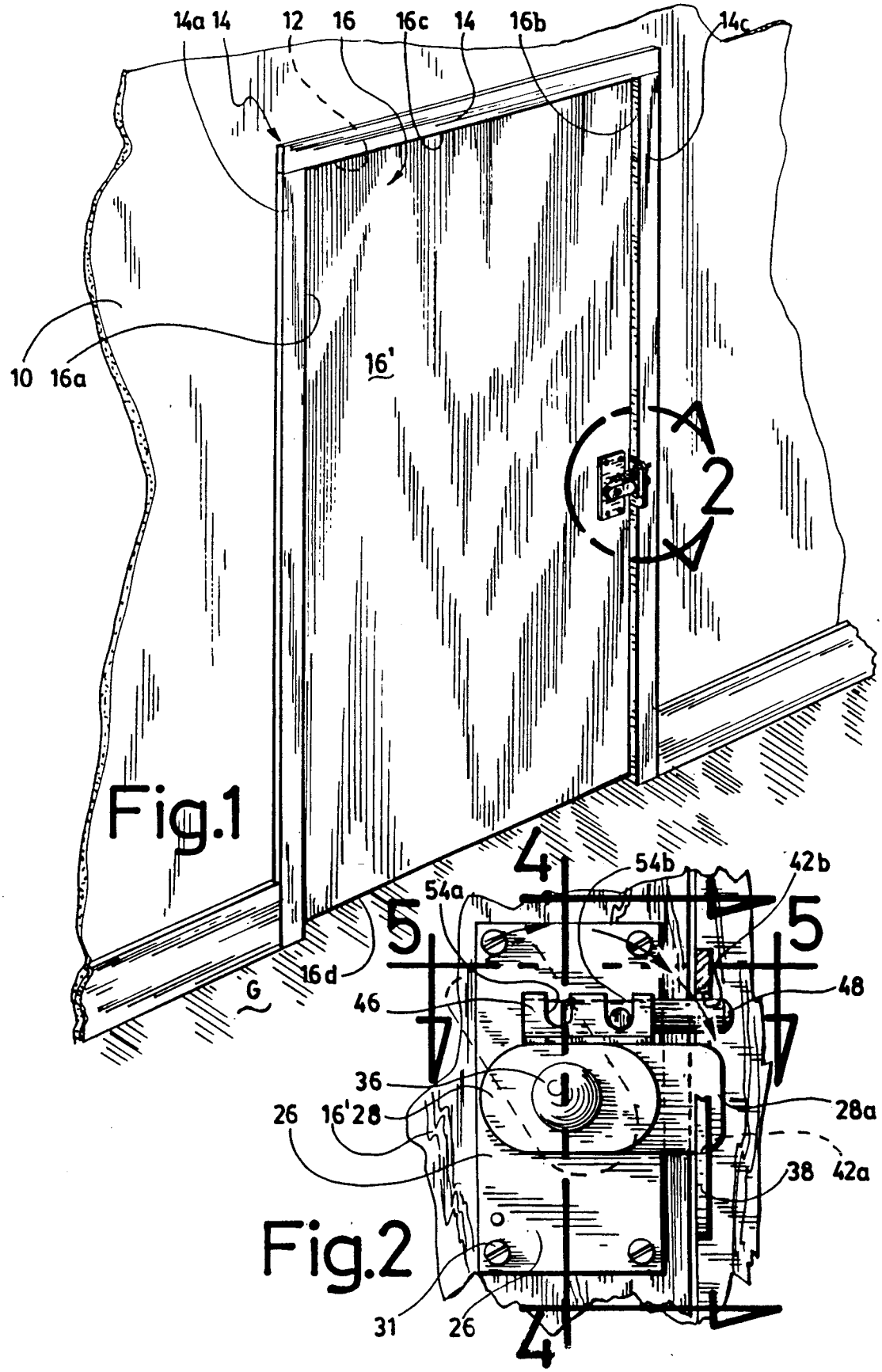
FIG. 1 is an isometric view of a wall in a room, and of a door hingedly mounted thereto, the door being provided with a door lock and latch assembly according to the invention.
FIGS. 2–3 are enlarged views of area 2 in FIG. 1, showing the lock and latch assembly in operative and inoperative position respectively.

According to the heart of the invention, there is further provided a releasable latch member 44, to releasably lock the lock bar extension 28*b* into jamb plate aperture 42. Latch 44 includes a rigid, hollow, cylinder member 46 laterally anchored to lock bar 28 for rotation therewith. Cylinder 46 is opened at least at its outer end and is coplanar with lock bar extension 28*b* and defines a lengthwise axis parallel with the direction of extension 28*b*, but extends short of the outer end of the latter. A full, cylindrical stem 48 is slidingly engaged through the hollow of cylinder 46. Stem 48 carries a transverse arm 50 extending through a slit 52 made lengthwisely through the wall of cylinder 46 and joining to transverse notches 54*a*, 54*b* made at both ends of slit 52; stem 48 is movable between a first, retracted, limit position (FIG. 3), with arm 50 engaging or in register with notch 54*a*, and a second, extended, limit position (FIGS. 2 and 5), engaging or in register with notch 54*b*. In the second limit position, stem 48, when lock bar extension 28*b* extends through aperture 42, also extends through aperture 42 above lock bar extension 28*b* (which preferably abuts against the lower edge of aperture 42 by its own weight, as detailed in the background of the invention paragraph). Arm 50, when pivoted into notch 54*b*, locks stem 48 into its extended position in which it will abut jamb plate top edge 42*b* if one tries to rotate lock bar 28 towards its door unlocking position.

It is understood that, with such an arrangement, it would be impossible for an unauthorized person to open the closed door 16 from the exterior of the room, simply by chipping the flange section 18 of jamb 14*b* which registers with the lock 20, by inserting a thin implement, such as a blade or a credit card or the like through the air gap between the free door edge 16*b* and the jamb 14*b*, and by trying to lift with the implement the lock bar 28 to pivot around its horizontal axis 22 in order to clear the aperture 42 of jamb plate 38. Indeed, extended latch stem 48 projects beyond the outermost arcuate path of the rotating lock bar 28, and therefore prevents upward pivotal of the lock bar 28 by abutting against the top edge 42*b* of the jamb plate aperture 42.

Only a person inside the room can in fact unlock the door means 20 by first retracting stem 48 and rotating the same so that arm 50 engages notch 54 to retain stem 48 in retracted position. Then lock bar 28 can be manually rotated to its door opening position.

Preferably, lock bar 28*b* and associated latch stem 48 should be horizontal in their operating positions (FIG. 2), i.e. that jamb plate 38 should be positioned relative to door plate 26 in such a way that lock bar extension 28*b* be horizontal when abutting against the lower edge 42*a* of jamb plate aperture 42.

The elements constituting the lock means 20 should be made from one or more rigid, sturdy materials, e.g. suitable tamperproof, metallic alloys; except for ornamental plug 36.

It should be noted that cylinder 46 which serves to guide stem 48 can be replaced by a corresponding guiding passage made in lock bar 28, since the stem diameter can be smaller than shown.

I claim:

1. A door locking device for use in edgewisely locking to a first jamb of a door frame, a door hingedly mounted to the opposite jamb of that door frame, said door defining an interior wall facing a room and an exterior wall, the door locking device comprising:

(a) a lock bar to be mounted to the door;

(b) means for anchoring said lock bar to the door swinging edge section against the interior wall thereof;

(c) pivoting means for pivotal movement of said lock bar about a plane substantially parallel to said door;

(d) a jamb plate having an aperture and to be mounted to said first jamb for releasable engagement of a free edge portion of said lock bar into said aperture in a transverse, door-locking position once said door is closed, said lock bar pivotable to a door unlocking position by clearing said aperture;

(e) an elongated latch member, carried by said lock bar for pivotal movement therewith and longitudinally movable relative to said lock bar between an inoperative position, retracted from the locking bar free edge portion for clearing said jamb plate aperture, and an extended, operative position, protruding from said locking bar free edge portion, in which it is adapted to transversely engage said jamb plate aperture, once said door is closed and said lock bar is in door-locking position; and latch member locking means, for releasably locking said latch member movable part in at least its extended position; wherein said latch member, in its said extended position, positively maintains said lock bar in door-locking position by preventing pivoting of said lock bar to its door unlocking position.

2. A locking device as defined in claim 1, wherein said plane of pivotal movement of said lock bar is located interiorly beyond the plane of said jamb, when the door is closed; said jamb plate being anchored to said first jamb orthogonally to the plane of the closed door; said aperture defining top and bottom edges, said lock bar, in its transverse, door locking position, extending horizontally through said aperture and adjacent one of said bottom edges thereof and spaced from the other of said edges thereof, said latch member, in its said extended position, extending within the clearance within said aperture between said aperture other edge and said transverse lock bar, and being of such dimensions as to positively engage said other edge upon an attempt to rotate said lock bar away from its door-locking position.

3. In combination, a door frame having two opposite upright jambs;

a door, hingedly connected at a first side edge section to a first jamb, and defining an opposite swinging edge section adapted to come in register with the second jamb, and further defining interior and exterior main walls; and a door lock assembly comprising a first lock section, anchored to said door swinging edge section, and a second lock section, anchored to said second jamb in horizontal register with said first lock section; wherein said first lock section comprises:

a base plate, anchored against said interior wall of the door at an intermediate height thereof;

a sturdy lock bar, to be mounted to said base plate;

means for firmly anchoring said lock bar to said door while enabling rotation of said lock bar relative to the door about a plane substantially parallel to said door; said lock bar pivotable between a door locking position in which the lock bar outer end extends beyond the door swinging edge section and a door unlocking position in which the lock bar outer end is retracted from said door outer edge section; and an elongated latch member, defining a rigid stem, slidably carried by said lock bar for longitudinal movement relative to said lock bar between an inoperative retracted position and an at least partially outwardly extending, operative position relative to the outer end of said lock bar;

said second lock section consisting of a rigid jamb plate, anchored to said second jamb and defining an elongated, vertically extending aperture engaged by said lock bar and stem in their respective door locking and operative positions when said door is closed and locked;

wherein any attempt to rotate said lock bar to its door unlocking position is prevented by engagement of said stem with an edge of said jamb plate aperture.

4. A door and lock combination as claimed in claim 3, further including latch member locking means, for releasably locking said stem to said lock bar in at least its said operative position.

5. A door and lock combination as claimed in claim 3, wherein said means for anchoring said lock bar to said door and for enabling rotation of the former, includes a bolt extending through said door.

6. A door and lock combination as claimed in claim 3, wherein, in their respective door locking and operative positions, said lock bar abuts against the bottom edge of said jamb plate aperture and extends horizontally, while said stem extends through a major portion of the clearance above the lock bar within said aperture and almost abuts against the top edge of said jamb plate aperture, so as to prevent upward pivot motion of the lock bar unless the stem is brought to its retracted position.

* * * * *